US007182666B2

(12) United States Patent
Frontera Castaner

(10) Patent No.: US 7,182,666 B2
(45) Date of Patent: Feb. 27, 2007

(54) WING-ATTACHMENT MECHANISM FOR A MODEL AIRPLANE

(75) Inventor: Miguel A. Frontera Castaner, St. Joseph, IL (US)

(73) Assignee: Hobbico, Inc., Champaign, IL (US)

( * ) Notice: Subject to any disclaimer, the term of this patent is extended or adjusted under 35 U.S.C. 154(b) by 0 days.

(21) Appl. No.: 10/841,126

(22) Filed: May 7, 2004

(65) Prior Publication Data

US 2005/0250407 A1 Nov. 10, 2005

(51) Int. Cl.
*A63H 27/127* (2006.01)

(52) U.S. Cl. ..... 446/36; 446/67

(58) Field of Classification Search ..... 446/30, 446/36, 61, 62, 66, 67; 244/123, 154; 403/408.1, 403/263, 355, 336, 337, 387, 388
See application file for complete search history.

(56) References Cited

U.S. PATENT DOCUMENTS 3,839,818 A * 10/1974 Heggedal ..... 446/62
3,858,349 A 1/1975 McClendon
3,869,823 A * 3/1975 Powers et al. ..... 43/3
3,916,560 A * 11/1975 Becker ..... 446/62
3,935,664 A 2/1976 Neuhierl
4,233,773 A 11/1980 Jones
4,272,912 A 6/1981 Lapierre
4,444,365 A * 4/1984 Heuberger ..... 244/48
4,591,114 A 5/1986 Block
4,714,444 A 12/1987 Rendel
4,863,412 A * 9/1989 Mihalinec ..... 446/66
5,547,306 A * 8/1996 Zakrajsek ..... 403/202
6,186,854 B1 2/2001 Lai
6,425,794 B1 7/2002 Levy et al.
2002/0069040 A1 * 6/2002 Omotani ..... 703/8

* cited by examiner

*Primary Examiner*—Kien Nguyen
(74) *Attorney, Agent, or Firm*—Drinker Biddle & Reath LLP

(57) ABSTRACT

A mechanism for attaching a wing to a fuselage of a model airplane. The mechanism includes a mounting base, a wing bolt, a retaining device that holds the wing bolt in the mounting base, and a flexible support member positioned between the retaining device and the mounting base. A wing assembly for a model airplane is also disclosed. The wing assembly includes a first and second wing section and a wing rib for connecting the two sections. A means for connecting a wing assembly to a model airplane is also disclosed.

44 Claims, 10 Drawing Sheets

WING-ATTACHMENT MECHANISM FOR A MODEL AIRPLANE

FIELD OF THE INVENTION

This invention pertains to assembly components for a model aircraft and, more particularly, to an attachment mechanism that allows the wing to be attached to the fuselage.

BACKGROUND OF THE INVENTION

When building a model of any kind, it is important to make sure that all of the various pieces of the model are aligned and securely attached to one another. This is important not only for aesthetic reasons but also to allow an operating model to function properly. One of the most important sections to assemble with respect to a model airplane is the wing section. This is because the wing section generates lift and includes the flight control surfaces known as the ailerons.

In order for an aircraft to fly, the wings must generate lift. Lift results from the camber in the wing causing the air passing over the top of the wing to travel a greater distance than the air traveling along the underside of the wing. Because the air on the top of the wing must travel a greater distance, the air must accelerate and flow faster than the air on the bottom of the wing. The accelerated airflow on the top of the wing results in less pressure on the top of the wing than on the bottom, thereby generating lift.

In a model airplane, particularly a radio-controlled model airplane, it is important that the wings be attached to the fuselage in such a manner that the wing will not break should a wingtip strike the ground during a landing. Various devices have been used in the prior art to protect the wings and fuselage in the event of a hard landing. For example, U.S. Pat. No. 6,425,794 (Levy et al.) discloses the use of breakaway links that cause the wing to separate from the fuselage. This separation of the wing from the fuselage prevents the airframe from breaking apart should the wing strike the ground during a hard landing.

Although the breakaway links provide a more realistic look to the model airplane, they are limited in that every time a wing strike occurs, the operator is required to reinstall the wing. This task may be time-consuming and require the use of particular tools.

U.S. Pat. No. 4,272,912 (Lapierre) discloses the use of rubber or elastic bands to connect the wing to the fuselage. The use of these bands allows the wings to pivot under the effect of a hard landing. A shortcoming of this feature is that it does not allow for a realistic look to the airplane. Therefore, a wing attachment mechanism that allows the wing to absorb the shock of a crash landing while, on most occasions, remaining attached to the aircraft would be an important improvement in the art.

BRIEF SUMMARY OF THE INVENTION

The invention is directed to a mechanism for attaching a wing to a fuselage of a model airplane. The mechanism is comprised of a wing bolt and a flexible support member that secures the wing bolt to the fuselage. In one version of the invention, the mechanism is further comprised of a mounting base, and the flexible support member secures the wing bolt in the mounting base. In still another version of the invention, a retaining device holds the wing bolt in the mounting base, and the flexible support member is positioned between the retaining device and the mounting base.

Another embodiment of the invention is directed to a wing assembly for a model airplane. The inventive wing assembly is comprised of a wing, a dowel extending from the wing, and a flexible support member, attached to a portion of an airplane fuselage, securing the wing bolt to the fuselage. In one version of this embodiment, the wing includes a first and a second wing section, a wing rib connecting the first wing section to the second wing section, a dowel extending from the wing rib, a mounting base attached to an aircraft fuselage, a wing bolt extending through the wing rib, and the flexible support member attached to a portion of the airplane fuselage, thereby securing the wing bolt to the fuselage. In still another version of the embodiment, a retaining device holds the wing bolt in the mounting base, and the flexible support member is positioned between the retaining device and the mounting base.

In yet another embodiment, the invention relates to a model airplane comprised of a fuselage having an opening in a top portion, a wing attached to the fuselage, a wing bolt passing through the wing and a flexible support member, whereby the flexible support member secures the wing to the fuselage.

In still another embodiment, the invention is directed to a means for connecting a wing assembly to a model airplane.

BRIEF DESCRIPTION OF THE DRAWINGS

FIG. 5(*b*) is a perspective view of the retaining device.

FIG. 5(*c*) is a top view of the retaining device.

FIG. 5(*d*) is a side view of the retaining device.

FIG. 6(*b*) is a perspective view of the flexible support member.

FIG. 6(*c*) is an end view of the flexible support member.

FIG. 6(*d*) is a side view of the flexible support member.

DETAILED DESCRIPTION OF THE INVENTION

Figure 1:
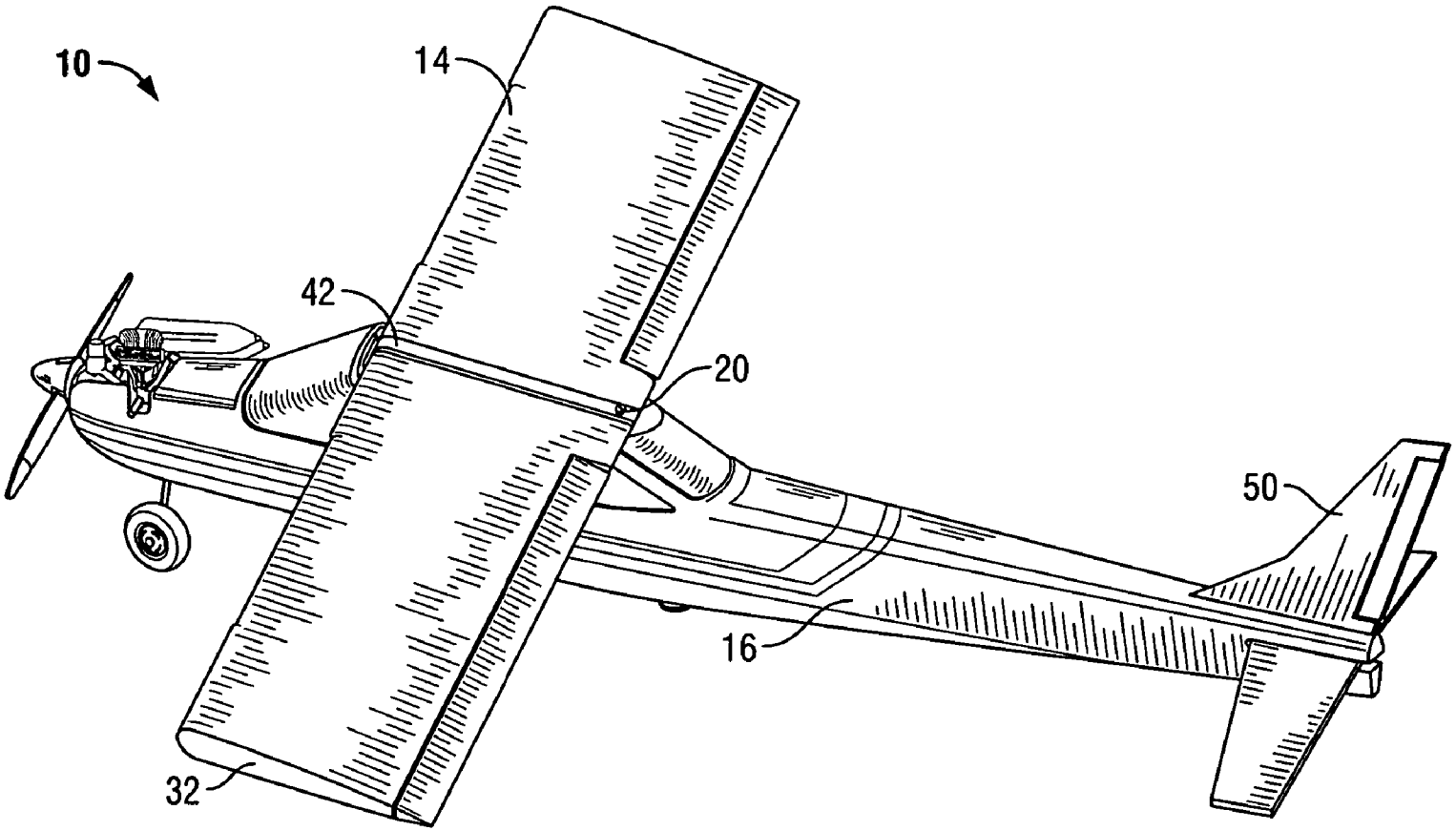
FIG. 1 is a perspective view showing a model airplane.
Figure 2:
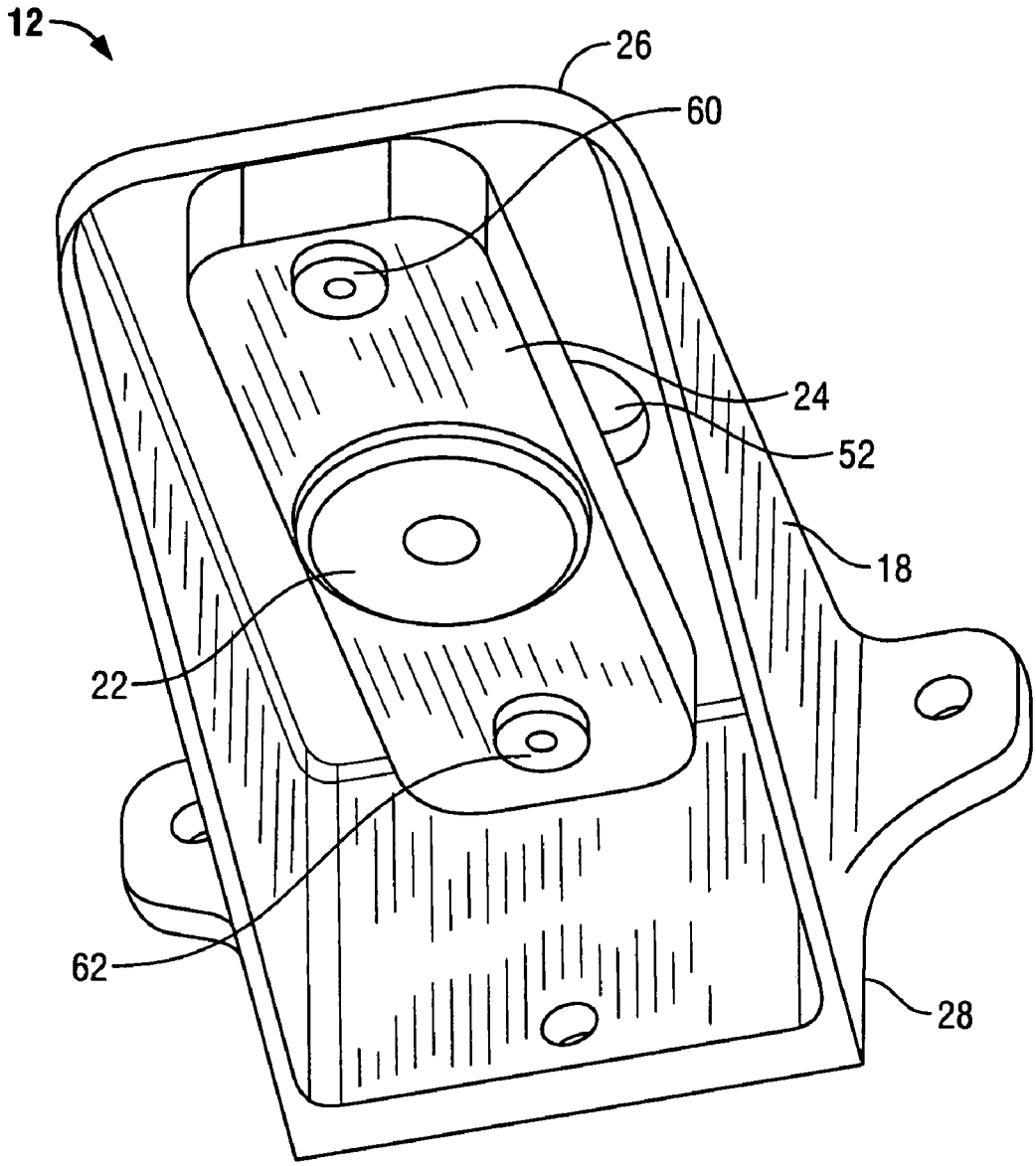
FIG. 2 is a perspective view showing the underside of the wing-mounting mechanism with the flexible support member secured to the mechanism by the retaining device.
Figure 3:
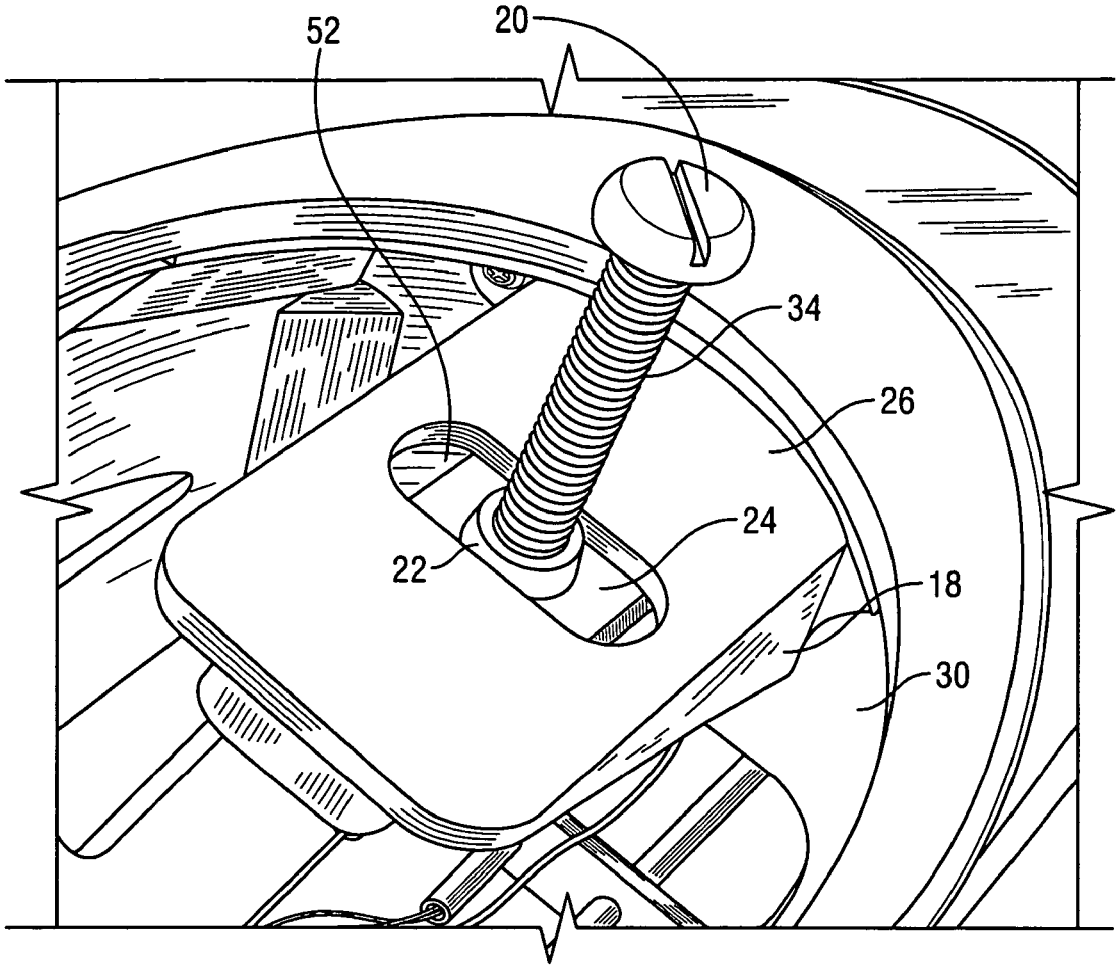
FIG. 3 is a perspective view showing the wing bolt positioned in the wing-mounting mechanism that is attached to the fuselage of the airplane.
Figure 4:
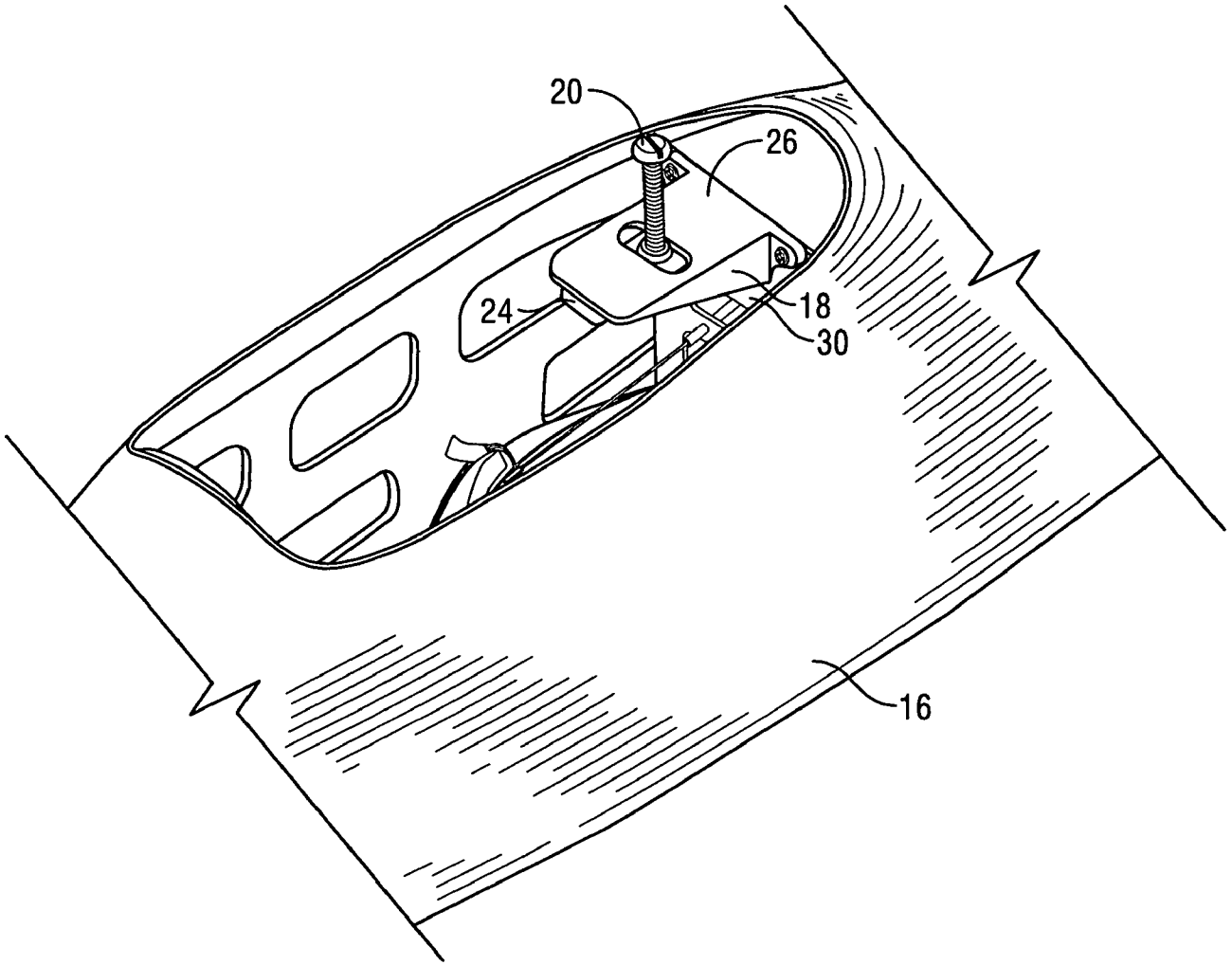
FIG. 4 is a perspective view showing the wing saddle in the top of the fuselage and the wing-mounting mechanism installed in the airplane.
Figure 5A:
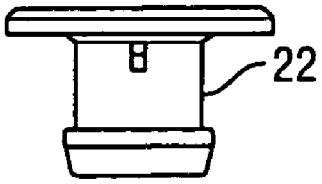
FIG. 5(*a*) is a side view of a retaining device.
Figure 5B:
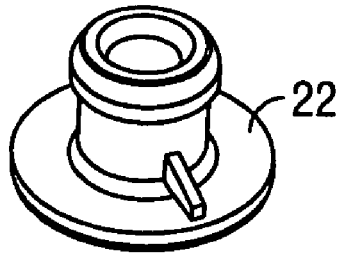
Figure 5C:
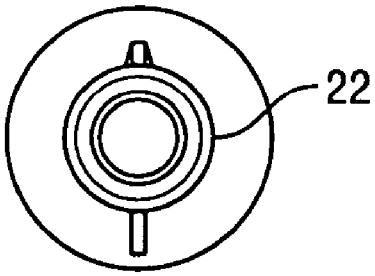
Figure 5D:
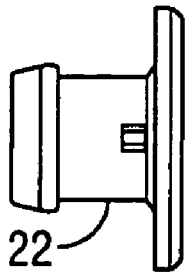
Figure 6A:
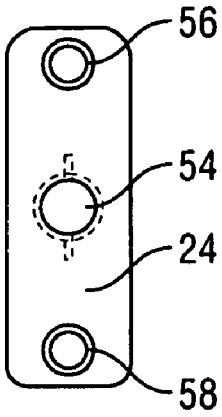
FIG. 6(*a*) is a top view of a flexible support member.
Figure 6B:
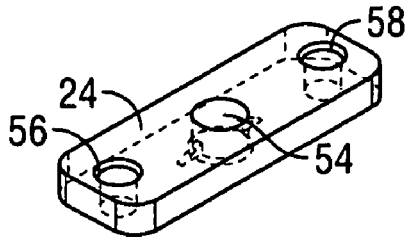
Figure 6C:
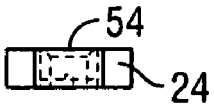
Figure 6D:
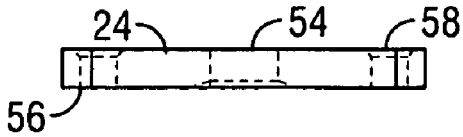

The invention relates to a model airplane 10, as shown in FIG. 1, and, more particularly, to a mechanism 12, as shown in FIGS. 2–4, for attaching a wing 14 to a fuselage 16 of a model airplane 10. The mechanism 12 is comprised of a wing bolt 20 and a flexible support member 24 securing the wing bolt 20 to the fuselage 16. In one embodiment of the invention, the mechanism 12 includes a mounting base 18, and the flexible support member 24 secures the wing bolt 20 in the mounting base 18. In a more particular version of this embodiment, a retaining device 22 secures the wing bolt 20 to the mounting base 18, and the flexible support member 24 is positioned between the retaining device 22 and the mounting base 18.

The retaining device 22 used in the invention may be a threaded washer, as shown in FIGS. 5(*a*)–(*d*), which may be manufactured of nylon. The mounting base 18 may also include a wing-attachment surface 26 and a fuselage-attachment surface 28 that is substantially perpendicular to the wing-attachment surface 26. When installed in the aircraft 10, as shown in FIGS. 3 and 4, the fuselage-attachment surface 28 is mounted to a frame 30 in the fuselage 16 in any of several ways known in the art, including, but not limited to, the use of a bolt, pin or glue. Once installed, the wing-attachment surface 26 may be oriented so as to be adjacent to the underside 32 of the center of the wing 14 in a high-wing model aircraft such as the one shown in FIG. 1. It must be noted, however, that the scope of the invention is not limited to a high-wing aircraft, as the wing-mounting mechanism 12 may be adapted for use with a low-wing airframe.

Figure 7:
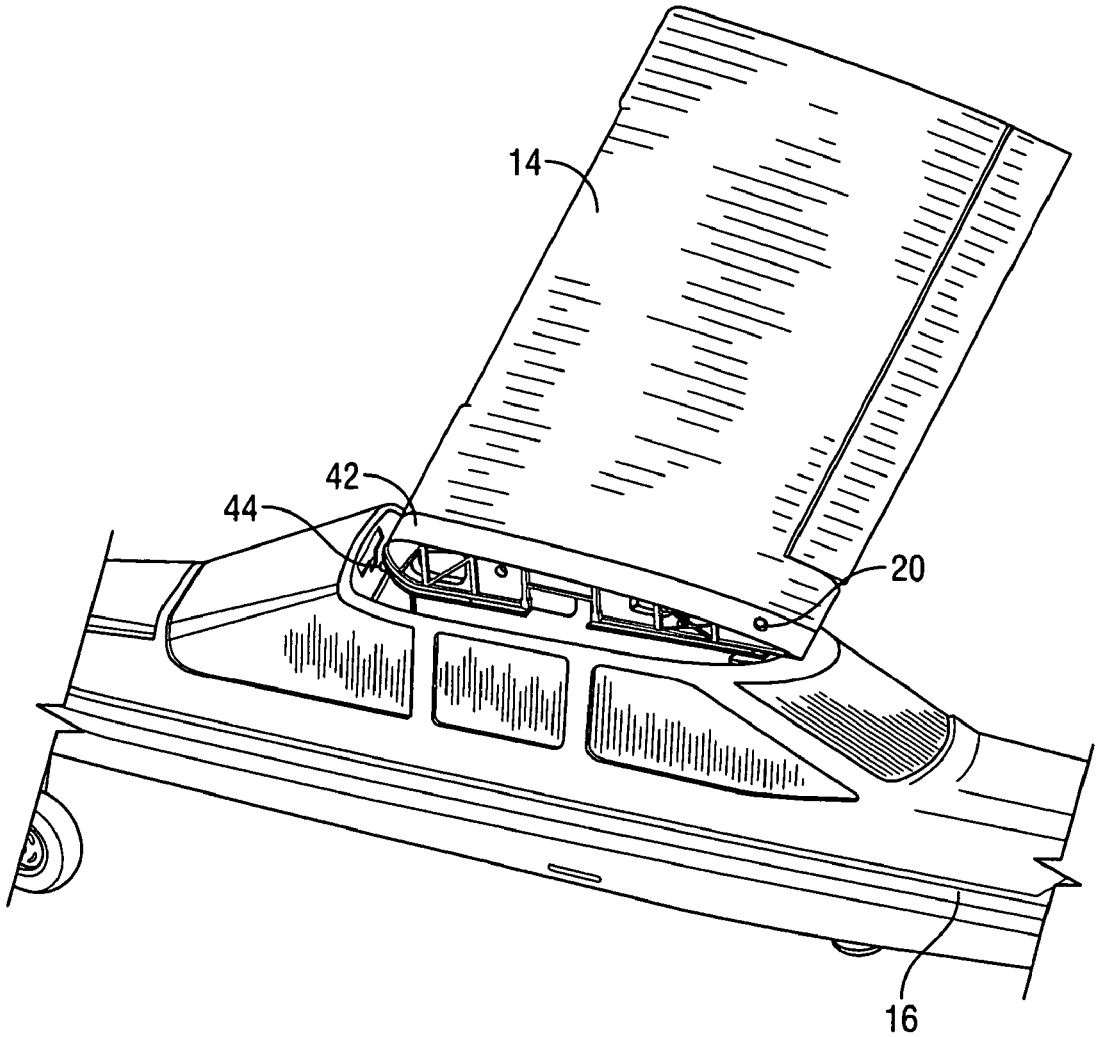
FIG. 7 is a perspective view showing one of the wing sections positioned with respect to the wing saddle in the fuselage.
Figure 8:
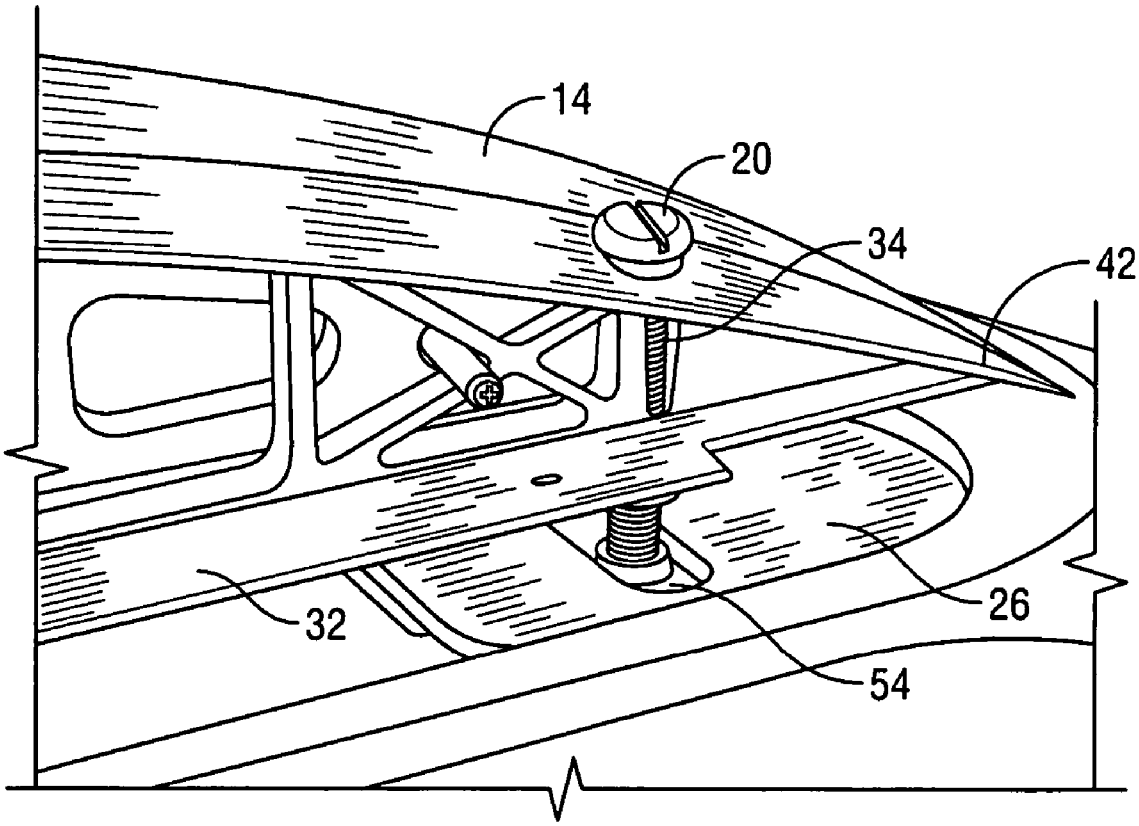
FIG. 8 is a perspective view of a portion of the wing assembly showing the wing bolt passing through the connecting rib and the mounting base of the wing-mounting mechanism.

Upon installation of the wing 14, a bolt 20, screw, or the like is used to attach the wing 14 to the wing-attachment surface 26, as shown in FIGS. 7 and 8. The bolt 20—which may be made of any suitable material, including nylon—may include a threaded portion 34. In connecting the wing 14 to the wing-attachment surface 26, the underside 32 of the wing 14 does not have to actually contact the wing-attachment surface 26 in order to be within the scope of the invention. For example, the underside 32 of the wing 14 may rest on the top of the wing saddle 48, as shown in FIGS. 7 and 8. The wing saddle 48 is an opening in the fuselage 16 that allows for the installation of the wing 14.

When in use, the flexible support member 24, shown in FIGS. 6(*a*)–(*d*), allows the mounting mechanism 12 to "give" or flex along with the wing 14 itself should the aircraft 10 experience a hard landing or a wingtip strike. This results from the flexible support member 24 absorbing the forces generated by the shock of the landing, thereby allowing movement of the wing-mounting bolt 20 so as to cushion the entire wing.

The flexible support member 24 may be manufactured of rubber and may include an opening 54 that allows for receipt of the wing-mounting bolt 20. Two additional openings 56, 58 may be included to allow the flexible support member 24 to be attached to the mounting base 18 through the use of pins or protrusions 60, 62 on the underside of the wing-attachment surface 26, as shown in FIG. 2.

Figure 9:
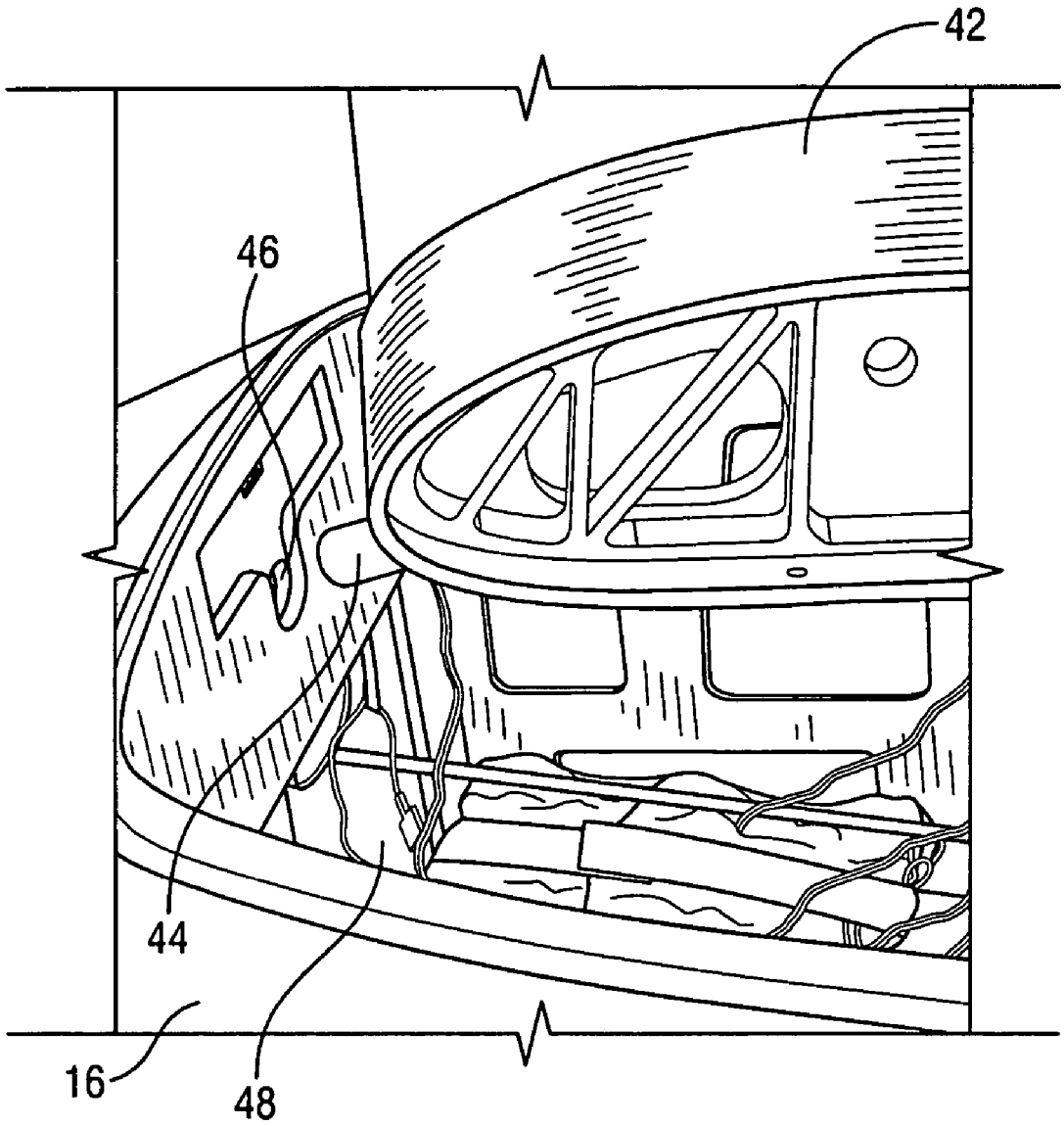
FIG. 9 is a perspective view showing a dowel extending from the front portion of the connecting rib and a dowel-receiving receptacle in the fuselage.
Figure 10:
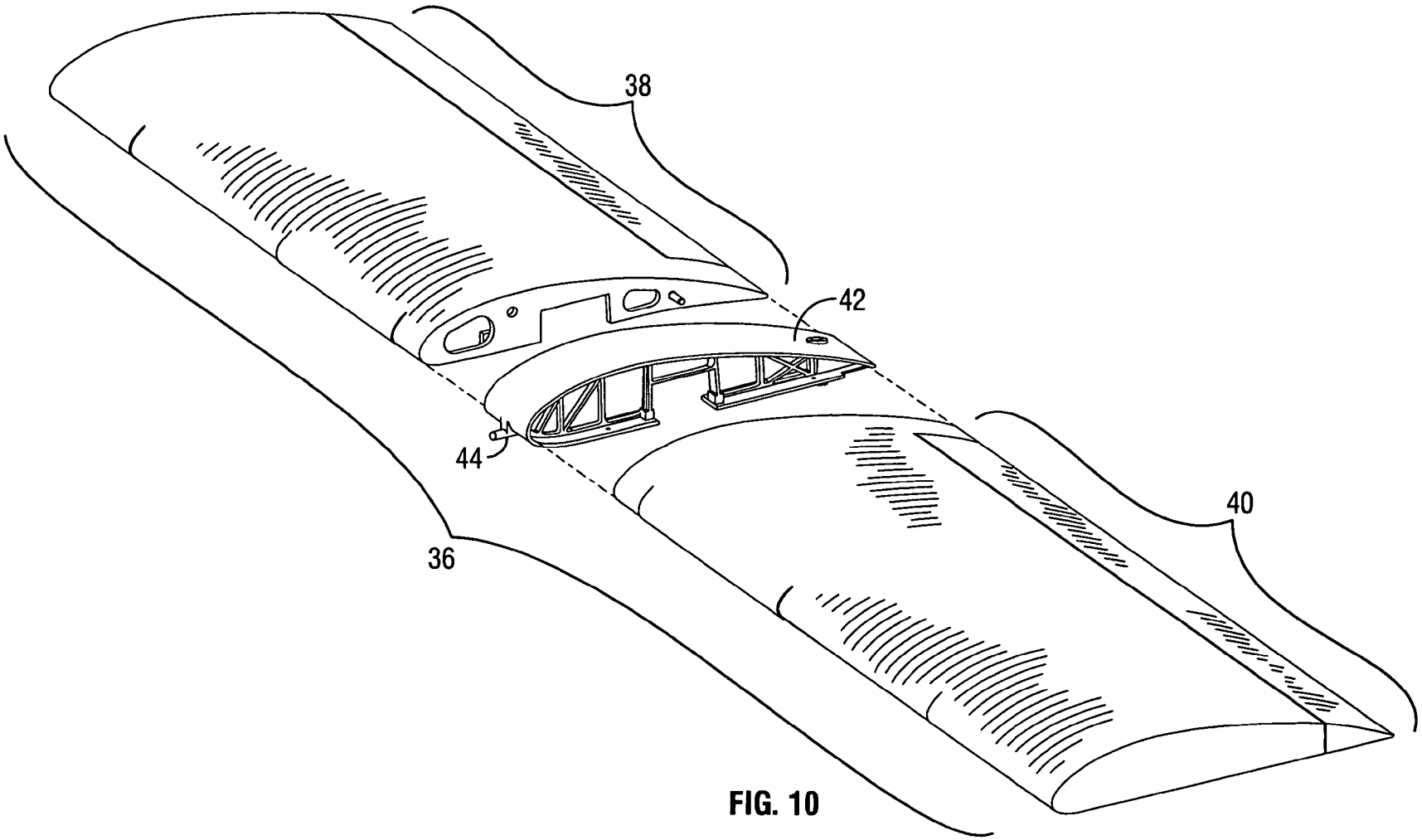
FIG. 10 is a perspective view of the complete wing showing a first and second wing section and the connecting rib.

The invention also is directed, as shown in FIG. 10, to a wing assembly 36 for a model airplane 10. The wing assembly 36 is comprised of a first and second wing section 38, 40, as shown in FIG. 10. A wing rib 42, as shown in FIGS. 1 and 7–10, connects the first and second wing sections 38, 40 with each other. As shown in FIGS. 7 and 9–10, a dowel 44 or similar protrusion extends from the wing rib 42. A mounting base 18 is attached to the airplane's fuselage 16, as shown in FIGS. 3 and 4. A wing bolt 20 extends through the wing rib 42 and the mounting base 18, while a retaining device 22 holds the wing bolt 20 in the mounting base 18 and a flexible support member 24 is positioned between the retaining device 22 and the mounting base 18.

In order to install the wing assembly 36 on the airplane 10, the dowel 44 extending from the wing rib 42 is positioned in a receptacle 46 located in the front portion of the fuselage 16, as shown in FIG. 9. This allows the front portion of the wing assembly 36 to be secured in the opening or wing saddle 48 in the top of the fuselage 16. Once the dowel 44 is positioned in the fuselage 16, the rear portion of the wing assembly 36 is aligned with the mounting base 18 that is secured to the fuselage 16, proximate the tail portion 50 of the aircraft 10. The mounting base 18 includes an opening 52 in a wing-attachment surface 26 that is adjacent to the underside 32 of the aircraft wing 14 in a high-wing model aircraft. A wing bolt 20 extends through the rear portion of the wing 14 and into the opening 52 in the mounting base 18, where it is retained in the mounting base 18 by a retaining device 22, preferably a threaded washer.

Positioned between the retaining device 22 and the mounting base 18, however, is a flexible support member 24. The flexible support member 24, which can be made out of rubber or any elastic substance, absorbs the shock associated with a hard landing and allows the retaining device 22 to flex should the wing 14 receive a large jolt. This flexing is facilitated because once the rear portion of the wing 14 is aligned with the mounting base 18, the wing bolt 20, which may be made of nylon, is inserted through the wing 14 and the mounting base 18 into the retaining device 22. Once this is completed, the retaining device 22 or nut is tightened, thereby pulling the retaining device 22 up slightly toward the underside 32 of the wing 14.

Should the aircraft 10 experience a hard landing, the flexible support member 24 and the retaining device 22 flex, thus allowing the wing 14 to absorb the shock of the landing. If the jolt caused by the landing is big enough, the retaining device 22 flexes enough to lift the wing dowel 44 out of the receptacle 46 in the front of the wing saddle 48, thereby allowing the wing 14 to separate from the fuselage 16. This separation prevents the wing 14 from breaking. If the jolt caused by the hard landing is strong enough, the wing bolt 20 attaching the rear portion of the wing 14 to the fuselage 16 may break. This too would allow the wing 14 to separate from the fuselage 16.

By allowing the wing 14 to separate from the fuselage 16 in the event of a hard landing, the structural integrity of the wing 14 is preserved. Therefore, the operator of the model airplane 10 need only reinstall the wing 14 or, at most, replace the wing bolt 20. Replacement of the wing bolt 20 is considerably less expensive than replacing the entire wing 14 of the aircraft 10.

Although in the embodiment described herein, the wing 14 was referred to as having a first and second wing portion 38, 40, a one-piece wing section could be used without departing from the scope or spirit of the invention. Furthermore, a multisection wing structure may also be used.

The invention also discloses a means for connecting a first and second wing portion 38, 40 to each other, as well as a means for attaching the wing portions 38, 40 to a fuselage 16 of a model airplane 10. The first and second wing portions 38, 40 may be secured to one another through the use of a connecting rib 42. The assembled wing section may then be attached to the fuselage 16 through the use of an attachment bolt 20, a means for retaining the attachment bolt 20 in the airplane 10, and a means for allowing the wing assembly 36 to flex with respect to the airplane fuselage 16.

The use of the terms "a," "an," "the" and similar referents in the context of describing the invention (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples or exemplary language (e.g., "such as") provided herein is intended merely to better illuminate the invention and does not pose a limitation on the scope of the invention unless otherwise claimed. No language in the specification should be construed as indicating any nonclaimed element as essential to the practice of the invention.

Preferred embodiments of this invention are described herein, including the best mode known to the inventors for carrying out the invention. It should be understood that the illustrated embodiments are exemplary only and should not be taken as limiting the scope of the invention.

What is claimed is:

1. A mechanism for attaching a wing to a fuselage of a model airplane, the mechanism comprised of:

a wing bolt including a threaded portion;

a mounting base;

a retaining device configured to secure the wing bolt to the mounting base; and a flexible support member between the retaining device and the mounting base, the flexible support member configured to receive the threaded portion and adapted to secure the wing bolt to the fuselage, wherein the flexible support member secures the wing bolt in the mounting base.

2. The mechanism of claim 1, wherein the retaining device is a threaded washer.

3. The mechanism of clam 2, wherein the threaded washer is manufactured of nylon.

4. The mechanism of claim 1, wherein the flexible support member is manufactured of rubber.

5. The mechanism of claim 1, wherein:

the mounting base includes a wing-attachment surface and a fuselage-attachment surface substantially perpendicular to the wing-attachment surface.

6. The mechanism of claim 5, wherein the wing bolt secures the wing attachment surface of the mounting base to the wing.

7. The mechanism of claim 5, wherein a nylon bolt is used to bolt the mounting base to the wing.

8. A wing assembly for a model airplane, the wing assembly comprised of:

a wing;

a dowel extending from the wing;

a wing bolt extending through the wing, the wing bolt including a threaded portion; and a flexible support member adapted to attach to a portion of an airplane fuselage and receive the threaded portion, thereby securing the wing bolt to the fuselage.

9. The wing assembly of claim 8, wherein:

the wing includes a first and a second wing section;

a wing rib connects the first and second wing sections;

the dowel extends from the wing rib;

the wing bolt extending through the wing rib; and the flexible support member is attached to a portion of an airplane fuselage securing the wing bolt to the fuselage.

10. The wing assembly of claim 8, further comprised of:

a mounting base attached to an airplane fuselage;

the wing bolt extending through the wing and a wing-attachment surface of the mounting base;

a retaining device holding the wing bolt in the mounting base; and the flexible support member positioned between the retaining device and the mounting base.

11. The wing assembly of claim 10, wherein:

a front portion of the fuselage includes a receptacle;

the wing dowel extending from the wing is positioned in the receptacle;

the mounting base is attached to the fuselage proximate a tail position of the airplane; and the wing bolt extends through a rear portion of the wing, the mounting base, the flexible support member and the retaining device, thereby attaching the wing assembly to the fuselage.

12. The wing assembly of claim 10, wherein the retaining device is a threaded washer.

13. The wing assembly of claim 12, wherein the threaded washer is manufactured of nylon.

14. The wing assembly of claim 8, wherein the flexible support member is manufactured of rubber.

15. The wing assembly of claim 8, wherein the wing bolt is a nylon bolt.

16. The wing assembly of claim 8, wherein:

the wing includes a lower surface configured to substantially seal an opening in an upper side of the fuselage;

the flexible support member is attached to a frame located in the opening; and the wing is positioned on top of the opening.

17. The wing assembly of claim 16, wherein:

a mounting base is attached to a frame located in the opening; and the flexible support member is located adjacent to the mounting base.

18. A model airplane comprised of:

a fuselage having an opening in a top portion;

a wing attached to the fuselage, the wine including a first wing section, a second wing section, and a wing rib configured to connect the first and second wing sections;

a wing bolt passing through the wing; and a flexible support member configured to secure the wing bolt to the fuselage.

19. The model airplane of claim 18, wherein:

a mounting base is attached to the fuselage;

the wing bolt extends through the wing and the mounting base; and the flexible support member secures the wing bolt in the mounting base.

20. The model airplane of claim 19, wherein:

a retaining device secures the wing bolt to the mounting base; and the flexible support member is positioned between the retaining device and the mounting base.

21. A wing assembly to a model airplane, the wing assembly comprised of:

a connecting rib connecting a first wing portion to a second wing portion;

an attachment bolt configured to extend through the connecting rib;

means for retaining the attachment bolt in the airplane; and means for allowing the first and second wing portions to flex with respect to a fuselage of the model airplane.

22. A mechanism for attaching a wing to a fuselage of a model airplane, the mechanism comprised of:

a fastener;

a mounting base;

a retaining device configured to secure the fastener to the mounting base; and a flexible support member between the retaining device and the mounting base, the flexible support member configured to secure the fastener to fuselage, wherein the flexible support member secures the fastener in the mounting base.

23. The mechanism of claim 22, wherein the retaining device is a threaded washer.

24. The mechanism of clam 23, wherein the threaded washer is manufactured of nylon.

25. The mechanism of claim 22, wherein the flexible support member is manufactured of rubber.

26. The mechanism of claim 22, wherein:

the mounting base includes a wing-attachment surface and a fuselage-attachment surface substantially perpendicular to the wing-attachment surface.

27. The mechanism of claim 26, wherein the fastener secures the wing-attachment surface of the mounting base to the wing.

28. The mechanism of claim 22, wherein the fastener is a bolt manufactured of nylon.

29. The mechanism of claim 22, wherein the fastener comprises a threaded portion.

30. A mechanism for attaching a wing to a fuselage of a model airplane, the mechanism comprised of:

a wing bolt including a threaded portion;

a mounting base including a wing-attachment surface and a fuselage-attachment surface substantially perpendicular to the wing-attachment surface; and a flexible support member configured to receive the threaded portion and adapted to secure the wing bolt to the fuselage, wherein the flexible support member secures the wing bolt in the mounting base.

31. The mechanism of claim 30, wherein:

a retaining device secures the wing bolt to the mounting base; and the flexible support member is positioned between the retaining device and the mounting base.

32. The mechanism of claim 31, wherein the retaining device is a threaded washer.

33. The mechanism of clam 32, wherein the threaded washer is manufactured of nylon.

34. The mechanism of claim 30, wherein the flexible support member is manufactured of rubber.

35. The mechanism of claim 30, wherein the wing bolt secures the wing-attachment surface of the mounting base to the wing.

36. The mechanism of claim 30, wherein a nylon bolt is used to bolt the mounting base to the wing.

37. A mechanism for attaching a wing to a fuselage of a model airplane, the mechanism comprised of:

a fastener;

a mounting base including a wing-attachment surface and a fuselage-attachment surface substantially perpendicular to the wing-attachment surface; and a flexible support member configured to secure the fastener to the fuselage, wherein the flexible support member secures the fastener in the mounting base.

38. The mechanism of claim 37, wherein:

a retaining device secures the fastener to the mounting base; and the flexible support member is positioned between the retaining device and the mounting base.

39. The mechanism of claim 38, wherein the retaining device is a threaded washer.

40. The mechanism of clam 39, wherein the threaded washer is manufactured of nylon.

41. The mechanism of claim 37, wherein the flexible support member is manufactured of rubber.

42. The mechanism of claim 37, wherein the fastener secures the wing-attachment surface of the mounting base to the wing.

43. The mechanism of claim 37, wherein the fastener is a bolt manufactured of nylon.

44. The mechanism of claim 37, wherein the fastener comprises a threaded portion.

* * * * *